United States Patent [19]

Foroulis

[11] 4,017,336

[45] Apr. 12, 1977

[54] SURFACE TREATMENT OF METALS

[75] Inventor: Z. Andrew Foroulis, Mendham, N.J.

[73] Assignee: Exxon Reseaarch and Engineeering Company, Linden, N.J.

[22] Filed: Jan. 7, 1976

[21] Appl. No.: 647,063

Related U.S. Application Data

[63] Continuation of Ser. No. 241,289, April 5, 1972, abandoned.

[52] U.S. Cl. ..... 148/6.35; 148/31.5; 196/46; 208/47; 208/177; 208/208 R

[51] Int. Cl.[2] ..... C23F 7/04

[58] Field of Search ..... 148/6.35, 6.3; 208/4.7, 208/177, 208; 196/46

[56] References Cited

UNITED STATES PATENTS

| | | | |
|---|---|---|---|
| 627,021 | 6/1899 | Theobald | 148/6.35 |
| 2,175,771 | 10/1939 | Giles | 148/6.35 |
| 2,269,601 | 1/1942 | Perrin | 148/6.35 |
| 2,591,460 | 4/1952 | Morrill | 148/6.35 |
| 3,125,471 | 3/1964 | Conner | 148/6.35 X |

*Primary Examiner*—Ralph S. Kendall
*Attorney, Agent, or Firm*—H. N. Wells; F. Donald Paris

[57] ABSTRACT

Resistance of iron, iron-chromium and iron-chromium-nickel alloys to corrosive attack by sulfur compounds at temperatures above 500° F. is improved by pretreating the metal under controlled conditions to form an extremely thin submicroscopic oxide film which serves as a corrosion resistant barrier.

6 Claims, 1 Drawing Figure

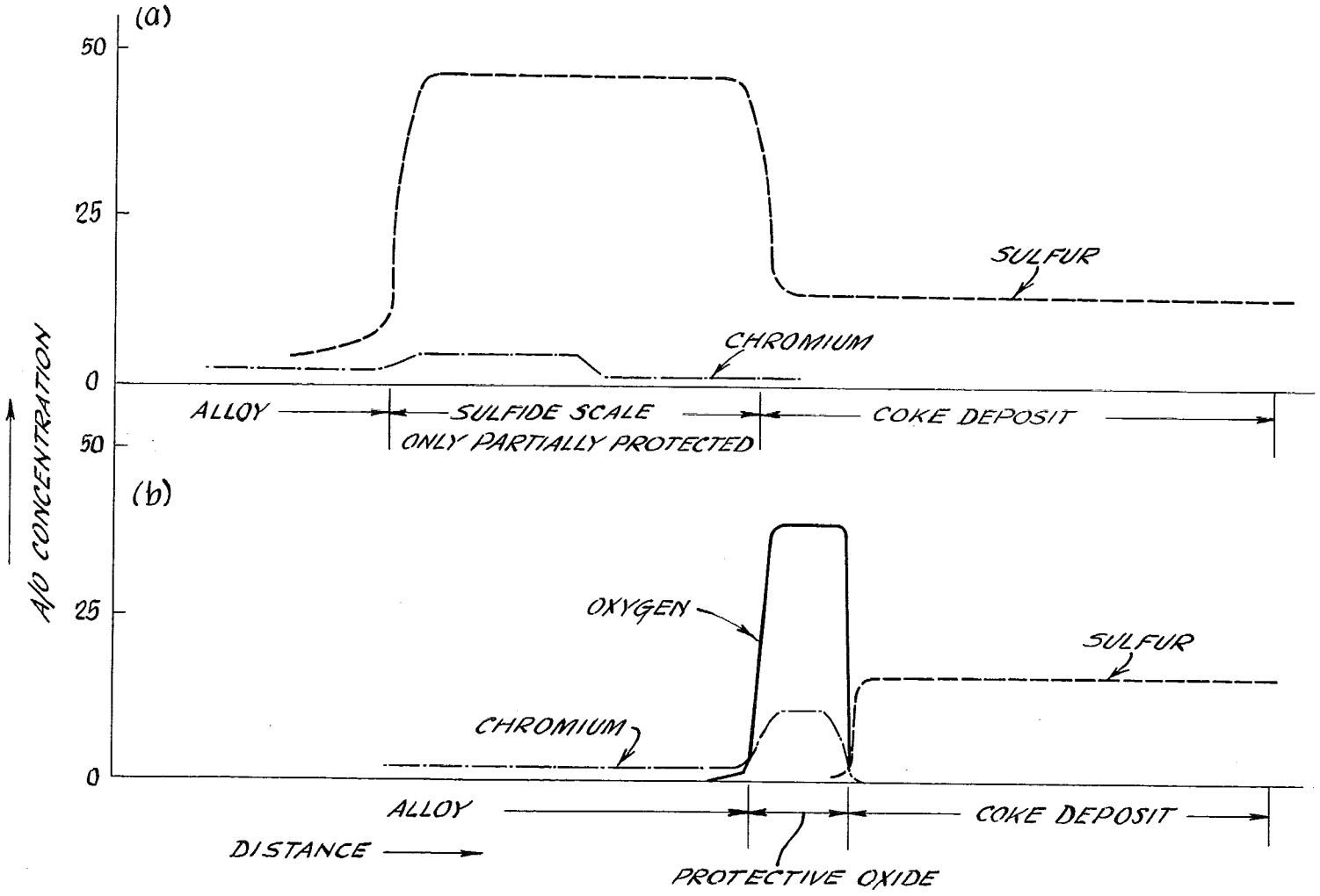
(a)
(b)
SULFUR
CHROMIUM
COKE DEPOSIT
SULFIDE SCALE
ONLY PARTIALLY PROTECTED
ALLOY
OXYGEN
PROTECTIVE OXIDE
DISTANCE
50
25
0
A/O CONCENTRATION

SURFACE TREATMENT OF METALS

This is a continuation of application Ser. No. 241,289, filed Apr. 5, 1972, now abandoned.

BACKGROUND OF THE INVENTION

The attack of sulfur compounds on metals at elevated temperatures is an exceedingly important phenomenon is petroleum refining. Compounds naturally occurring in crude petroleum and other compounds formed during the processing of the oil may corrosively attack at various places within the processing equipment. Typical sulfur compounds include $H_2S$, sulfides, disulfides, mercaptans, etc. The mechanism by which attack of metals by sulfur compounds occurs is not well understood. A typical result of what will be called herein "sulfidation attack" is the formation of a thick porous scale of iron sulfide which typically, being loose, tends to spall, thus exposing fresh surface. The scale itself has little or no protective effect and cannot be relied upon to reduce corrosion as is often the case in other metals where the initial layer of corrosion products will effectively protect the base metal beneath.

The consequences of such corrosive attack are severe both in terms of initial capital expenditures for expensive alloy equipment and in replacement costs for corroded equipment. Also, it is often the case that forced shutdowns of refinery processes occur earlier than expected due to equipment failure caused by sulfur compound corrosion. Such shutdowns, of course, result in large additional losses over and above those incurred by replacement of the equipment itself. The total cost of sulfur corrosion to the petroleum industry is not known but must represent a very large expense which must be borne by the refiner. Thus, mitigation of sulfur corrosion is of extreme importance to the petroleum refining industry. The solution to this problem has generally been approached by attempting to find improved metals or alloys which will successfully resist the aggressive attack of sulfur compounds. Generally iron alloys containing chromium and nickel have been used, since it has been found that adding chromium and nickel to steel provides protection against sulfur attack. It is necessary to build equipment of or lined with such alloys in order to prevent excessive corrosion in areas where it has been found that such attack occurs extremely rapidly. Unfortunately, the severity of corrosion attack and the exact location where it will occur cannot be predicted accurately, but is done empirically, judging from the quantity of sulfur present in the oil and from the conditions which exist in the equipment. Since crude oils contain differing amounts of sulfur and the sulfur compounds present differ from one to another, the corrosion which will result from processing of crude oils has not been predictable. Consequently, it has been found that equipment is either protected insufficiently, leading to premature failures and excessive replacement costs, or, more expensive materials are used in constructing refining equipment which later experience shows unnecessary in view of the corrosion actually experienced.

Another problem which results from corrosive attack by sulfur compounds is the fouling of equipment by the iron sulfide scales which form during the corrosion process and later spall off, fouling and plugging downstream equipment and causing unscheduled shutdowns.

Heretofore, no suitable method has been found to add protection for carbon steel, iron-chromium alloys, and iron chromium-nickel alloys, against aggressive attack by sulfur compounds. All that has been done is to predict the degree of corrosion that would be involved and use a material containing a sufficient quantity of chromium and nickel in order to give a satisfactorily low corrosion rate. Then, the equipment so protected would have a reasonable life expectancy and unscheduled and expensive shutdown would be avoided. The present invention discloses a novel method of producing a protective film on iron and iron alloys which may be used to significantly reduce the corrosion rate which would be otherwise experienced and thereby providing a longer useful service life for the equipment and reducing the cost of sulfidation attack.

SUMMARY OF THE INVENTION

The resistance of carbon steel, iron-chromium alloys and iron-chromium-nickel alloys to sulfur compound attack is improved by pretreating the metal under controlled conditions to form an extremely thin oxide film which serves as a barrier to sulfur attack. Pretreatment is accomplished by heating at temperatures above that to be experienced in refining service and in the presence of various oxidizers, preferably air, with conditions being controlled so as to favor the formation of the barrier oxide film. The temperature of treatment will vary depending upon the nature of the alloy to be treated, as will be disclosed in the description of the preferred embodiments which follows.

BRIEF DESCRIPTION OF THE DRAWING

The sole FIGURE shows in schematic form the distribution of critical elements in a metal under sulfidation attack, comparing unprotected metal with the same metal after the pretreatment which is the subject of the present invention.

DESCRIPTION OF THE PREFERRED EMBODIMENT

It has been found that corrosion of carbon steel and chromium or chromium-nickel steels may be substantially reduced by preoxidation treatment of those steels prior to exposure to the sulfur-containing environment. The film which is formed is submicroscopic, thought to be of the order of only 1 to 10 microns thick, which makes it difficult to accurately measure with any available equipment the exact nature of the film itself. However, experimental work done utilizing an electromicroprobe indicates, as shown by the sole FIGURE, that the oxide film does exist and presents a substantial barrier to sulfur compound attack.

It should be noted parenthetically that the electron microprobe is basically a combination of three instruments—an electron microscope, a spectrometer, and an X-ray tube. A fine electron beam produced from filament is accelerated to a voltage of 5 to 50 kilovolts and is finely focused on the specimen surface. The X-rays produced are detected by an X-ray spectrometer, analyzed, and then recorded by appropriate means. By this technique, individual elements within a few microns thickness of the surface layer can be located and their concentration approximately determined as is indicated in the sole FIGURE.

The effectiveness of the pretreatment is illustrated in the following table which shows corrosion data at 700°

F. for various steels which have been exposed to an Arabian light crude containing 1.58% total sulfur, with and without preoxidation treatment.

TABLE

| | Corrosion Rate, Mils/yr. | | | | |
|---|---|---|---|---|---|
| | Without Pretreatment | With Pretreatment, Temperature of preoxidation in Air | | | |
| | | 800° F. | 900° F | 1000° F. | 1200° F |
| Carbon Steel | 101 | 93 | 100 | 17 | 231 |
| 2-½ Cr. Steel | 103 | 110 | 166 | 76 | 83 |
| 5 Cr. Steel | 105 | 88 | 101 | 35 | 42 |
| 9 Cr. Steel | 91 | 72 | 69 | 33 | 0 |
| 12 Cr. Steel | 77 | 68 | 43 | 23 | 11.2 |
| 304 Cr-Ni Steel | 30 | 22 | 22 | 9.5 | 24 |
| 347 Cr-Ni-Cb-Ta Steel | 24 | 22 | 30.9 | 13.5 | 3.6 |

The above table illustrates that the corrosion rate is extremely high without the preoxidation treatment, illustrating also that adding chromium and nickel reduces the corrosive attack to acceptable but still high levels. Thus, chromium and chromium-nickel steels are ordinarily used in protecting refining equipment against sulfidation attack. The table also illustrates that preoxidation treatment must be done at carefully preselected temperatures if the film formed is to be protective. It appears that carbon steel and low-chrome steels are best protected by preoxidation temperatures at about 1000° F., whereas somewhat higher temperatures, about 1200° F., are more effective for the higher chromium and chromium-nickel steels. The table illustrates the desirability of determining the precise conditions under which preoxidation may have its best effect. Precisely 1000° F. for carbon steel and low chromium steels, or alternatively 1200° F. for high chromium steels or stainless steels are not necessarily the optimum pretreat conditions. It is believed that the nature of the oxide film may vary in structure depending upon the conditions which have been selected for pretreatment and that careful selection must be made in order to obtain the optimum performance. With resulting oxide film being submicroscopic, it is difficult to analyze the effect of changes in the pretreat conditions independently of their secondary effect in mitigating sulfidation attack. The significant reduction in corrosion rate, which is found with properly selected pretreat conditions, may be very usefully applied in the specification of materials for use in refining equipment. The preoxidation treatment itself would ordinarily be done during the prestart-up period prior to introducing crude oil into the processing units.

Although preoxidation in its simplest form, heating in air for 24 hours at elevated temperatures, is an effective means of providing pretreatment, it is within the scope of the invention to use other oxidizers such as oxygen, water vapor, hydrogen peroxide, or others, in order to form the oxide film. It should be understood, however, that with the use of other oxidizers that different conditions other than those found to be useful for air may be preferred.

That the pretreatment is effective in mitigating corrosion from sulfur compounds is shown by the table given above. The presence of an oxide film which has a substantial barrier effect is clearly illustrated in the sole FIGURE which compares the results of electron microprobe analysis of the key elements, traversing from the sulfur-bearing environment across the film and into the metal itself. The FIGURE represents analysis made of two specimens of iron-chromium steel (A and B) exposed to sulfur corrosion by crude such as was illustrated in the table above. Such conditions lead to the deposit of coke on the metal surface which is illustrated at the portion of the extreme right of each diagram.

In (a), it can be seen that the sulfur concentration remains uniform in the coke deposit until the interface between the sulfide scale and the coke is reached where the sulfur concentration sharply increases to a new plateau and remains constant until the interface between the sulfide scale and the metal is reached. The the sulfur concentration drops sharply again as the electron microprobe trace moves into the alloy itself. It will be noted that there is evidence of sulfur migration into the alloy which presumably is the beginning of the formation of sulfide scale under that already formed. The other element shown in diagram (a) is chromium which is not present in the coke deposit but is found in the alloy and in the sulfide scale as well. It appears that there is an increase in concentration in the sulfide scale which may be attributed to a migration of chromium from the alloy into the scale as a part of the reaction between the chromium steel and sulfur.

Turning now to diagram (b), a typical electron microprobe trace of an alloy which has been protected by preoxidation treatment discloses that sulfur is at a constant level through the coke deposit but that as soon as the protective oxide film is reached the sulfur concentration drops off to essentially zero, illustrating that the oxide film presents a significant barrier to the movement of sulfur which seems from diagram (a) to be characteristic of sulfidation attack. The oxide film itself is detected by the oxygen trace which shows a very high concentration of oxygen in a very narrow area between the coke deposit and the alloy with no oxygen being present in either of those two areas. The chromium trace again, as in diagram (a), shows an increase in chromium content in the oxide film itself which apparently has occurred from the migration of chromium into the oxide film. It is clear from comparing the curves that the oxide film represents a substantial barrier to the reaction of sulfur with the iron alloy and thus explains the marked reduction in corrosion rate shown in the table.

Due to the submicroscopic thickness of the oxide film which has been formed, it has not been possible to determine the structure of the barrier, but it is clear from the diagrams and from the corrosion data of the table that a barrier does exist and that it is effective even though the film is extremely thin.

The scope of the invention is not confined to the preferred embodiments but is defined by the claims which follow.

What is claimed is:

1. In a process for the refining of petroleum hydrocarbons in an environment wherein (a) free sulphur, (b) sulphur-containing compounds, or (c) mixtures of (a) and (b) are present and the refining process is operated under conditions such that the presence of (a), (b), or (c) would result in corrosive attack of steel equipment used for carrying out said refining, the improvement which comprises carrying out said refining with steel equipment which has been pretreated according to the following: selecting said steel from the group consisting of steel, chromium-containing steels, and chromium-nickel-containing steels, heating said steel in the presence of an oxidizing environment at temperatures above the expected surface temperature of said steel during said refining; forming a submicroscopic thin barrier on said steel, which barrier is resistant to (a), (b), or (c); and selecting said temperature so as to produce optimum resistance to corrosive attack by (a), (b), or (c).

2. In the process of claim 1 wherein said oxidizing environment is air.

3. In the process of claim 1 wherein steel is pretreated by exposure to air at a temperature of about 1000° F. for about 24 hours.

4. In the process of claim 1 wherein chromium containing steels are pretreated by exposure to air at a temperature of about 1000° F. for about 24 hours.

5. In the process of claim 1 wherein chromium-nickel containing steels are pretreated by exposure to air at a temperature of about 1200° F. for about 24 hours.

6. In the process of claim 1 wherein said oxidizing environment is selected from the group consisting of air, oxygen, water vapor, hydrogen peroxide, and mixtures thereof.

* * * * *